US009380885B1

(12) United States Patent
Nguyen

(10) Patent No.: US 9,380,885 B1
(45) Date of Patent: Jul. 5, 2016

(54) MODULAR SEAT AND SHELVING SYSTEM

(71) Applicant: Nguyen Nguyen, Chicago, IL (US)

(72) Inventor: Nguyen Nguyen, Chicago, IL (US)

( * ) Notice: Subject to any disclaimer, the term of this patent is extended or adjusted under 35 U.S.C. 154(b) by 0 days.

(21) Appl. No.: 14/569,190

(22) Filed: Dec. 12, 2014

(51) Int. Cl.

| | |
|---|---|
| ***A47B 57/00*** | (2006.01) |
| ***A47D 11/00*** | (2006.01) |
| ***A47B 87/00*** | (2006.01) |
| ***A47B 87/02*** | (2006.01) |
| ***A47D 1/10*** | (2006.01) |
| ***A47D 3/00*** | (2006.01) |

(52) U.S. Cl.
CPC ..... *A47D 11/00* (2013.01); *A47B 87/008* (2013.01); *A47B 87/0276* (2013.01); *A47D 1/10* (2013.01); *A47D 3/00* (2013.01)

(58) Field of Classification Search
CPC .... A47B 1/00; A47B 47/042; A47B 87/0207; A47B 87/0215; A47B 87/0223; A47B 87/0253; A47B 87/0276; A47B 87/008; A47D 11/00; A47D 1/10; A47D 3/00
USPC ..... 108/180, 91, 153.1, 64, 185; 312/111; 297/440.15, 1, 63, 62, 139; 211/194
See application file for complete search history.

(56) References Cited

U.S. PATENT DOCUMENTS 3,554,384 A * 1/1971 DeNatale ..... A47B 87/0276 211/194
3,836,218 A * 9/1974 Hallal ..... F16B 12/02 312/108
4,003,172 A * 1/1977 Pawl ..... E04B 2/08 52/279
4,262,605 A * 4/1981 Sokol ..... A47B 87/02 108/180
4,423,913 A * 1/1984 Lee ..... A47B 87/0276 211/194
5,775,046 A * 7/1998 Fanger ..... A47B 81/06 108/157.16
6,820,950 B1 * 11/2004 Sun ..... A47B 47/042 312/108
RE38,836 E * 10/2005 Krause ..... A47B 87/007 312/108
7,533,940 B1 * 5/2009 Zook ..... A47B 83/02 108/11
7,988,517 B2 * 8/2011 Bishop ..... A63H 33/082 446/108
8,468,957 B2 * 6/2013 Ruiz ..... A47B 91/00 108/91
8,573,716 B2 * 11/2013 Zalewski ..... A47B 47/0041 312/107
2008/0060964 A1 * 3/2008 Beckley ..... A47B 87/0276 206/504
2012/0242200 A1 * 9/2012 Keragala ..... A47B 47/042 312/111
2015/0008814 A1 * 1/2015 Yamamoto ..... A47B 87/0292 312/334.27

* cited by examiner

*Primary Examiner* — Jose V Chen
(74) *Attorney, Agent, or Firm* — James P. Muraff; Neal, Gerber & Eisenberg LLP

(57) ABSTRACT

A modular seating and shelving system including two or more blocks. Each block includes six sides defining an open interior. Each block includes a first side having a first protruding member, a second side having a recess, a third closed side, and fourth side having an opening to enable access to the open interior of each block. Each block may be utilized individually or may be interlocked with another block to form children's furniture such as seating or shelving. The configuration of the modular seating and shelving unit enables a children to utilize and maneuver blocks with ease to form various pieces of children's furniture.

20 Claims, 5 Drawing Sheets

MODULAR SEAT AND SHELVING SYSTEM

FIELD

This application generally relates to modular children's furniture. In particular, the application relates to a system of blocks which individually and when joined together can be utilized as furniture including, but not limited to chairs, tables, and shelving units suitable for children.

BACKGROUND

Existing children's furniture consists of modified versions of adult furniture, which is not designed with children in mind. Existing furniture is typically made of wood or bulky plastic that children either cannot maneuver themselves, or that children tend to stack and arrange in a manner that is unsafe. This leads to the risk of stacked furniture falling or causing harm to children.

SUMMARY OF THE INVENTION

The modular seat and shelving system design is customized for children's size, their ability to maneuver the furniture and their development. More specifically, the modular seat and shelving system includes two or more individual blocks that may be utilized individually or may be combined to form children's furniture. Various aspects of these blocks are designed specifically with children in mind. Particularly, the dimensions (i.e., height, length and width) of the individual blocks are determined proportionally to children so that children can sit on the blocks, or handle the blocks with ease. The material of each block is also determined with children in mind, so that children may lift, carry, and stack the blocks with ease. The manner in which the blocks are interconnected is also designed with children in mind so that blocks are interconnected easily by children, but are also secure to ensure the safety of the children utilizing the interconnected piece of furniture.

One of the benefits of the modular seat and shelving system is that it is made of light-weight material so that children can carry the blocks with ease. The blocks have interconnecting or interlocking components to allow children to stack them vertically and horizontally and work with other blocks to interconnect the blocks in a variety of ways. The interlocking aspects stabilize the overall unit when stacked. The chairs become a part of the children's imaginative play. Additionally, when combined, the blocks form shelves, tables and chairs.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed embodiments, and explain various principles and advantages of those embodiments.

DETAILED DESCRIPTION

A modular seating and shelving system is a system of individual blocks that individually and when joined together form different pieces of children's furniture. Each system includes at least two blocks. In one embodiment, the blocks are configured to be utilized individually as seating for children. In another embodiment two or more blocks may interlock with one another to form other children's furniture such as a table or a shelving unit.

Figure 1:
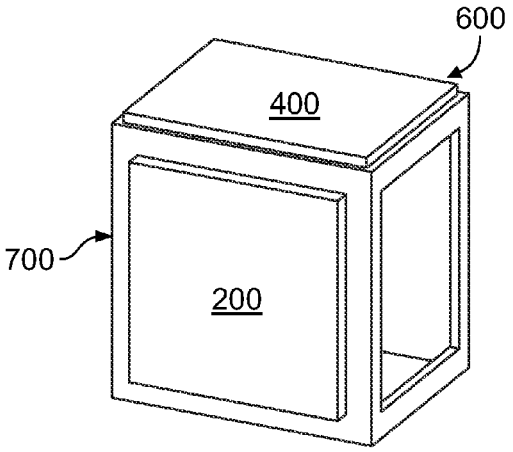
FIG. 1 is a perspective view of a single block in accordance with some embodiments.

As depicted in FIG. 1, each block 100 includes six sides 200, 300, 400, 500, 600, and 700. As shown in FIG. 1, the first side, 200, as will be described in greater detail below, includes a square shaped protruding member. As indicated in FIG. 1, adjacent to the first side 200, is the second side 300, which includes an exterior surface defining a recess. As further depicted in FIG. 1, the third side 400 is shown at the top of the block, this is the closed side of the block. FIG. 1 further shows the bottom side of the block is the fourth side 500, which has the opening. The fifth side 600 and the sixth side 700, are not visible in FIG. 1. The six sides of each block define an open interior. In one embodiment, the open interior is utilized as a cubby or shelf space. It should be appreciated that in one embodiment, each block of a modular seating and shelving system is of the same dimensions (i.e., length, width, and height) for a uniform shelving and seating system.

Figure 2A:
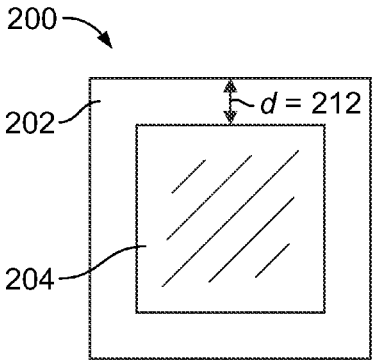
FIGS. 2A-2C are a plan view, a side view, and a perspective view of a first side of a block in accordance with some embodiments.
Figure 2B:
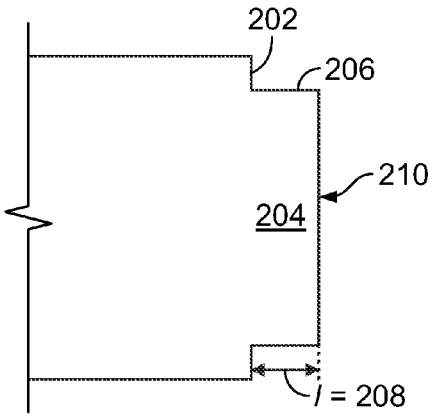
Figure 2C:
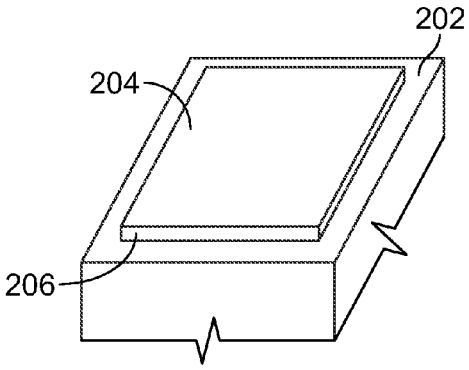

Referring to FIG. 2A, the first side 200 of each block of the modular seating and shelving system is depicted. FIG. 2A depicts a plan view of the first side 200, FIG. 2B depicts the side view of the first side 200, and FIG. 2C, depicts a perspective view of the first side 200 when the first side is viewed from the top of the block. The first side 200 of the block includes a first exterior surface 202 and a first protruding member 204 extending outwardly away from the interior of the block from the first exterior surface 202. The first protruding member 204 includes an outer surface 210 parallel to the first exterior surface 202. The first protruding member 204 includes a first lateral surface 206. The first lateral surface 206 extends perpendicular to the first exterior surface 202 away from the interior of the block to the outer surface 210 of the first protruding member. The length that the first lateral surface 306 extends in this direction is indicated as 208. The first lateral surface defines the outer perimeter of the first protruding member 204. The distance between the first lateral surface 206 and the outer edge of the first exterior surface 202 is indicated as a distance 212.

Figure 3A:
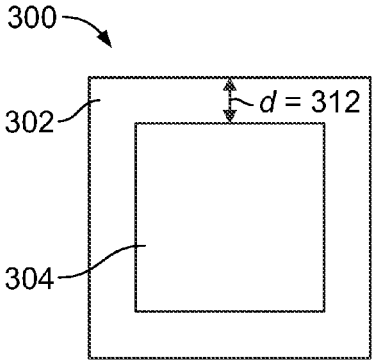
FIGS. 3A-3C are a plan view, a side view, and a perspective view of a second side of a block in accordance with some embodiments.
Figure 3B:
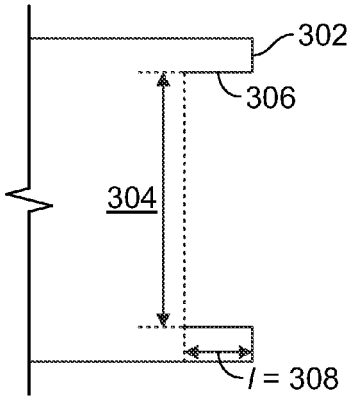
Figure 3C:
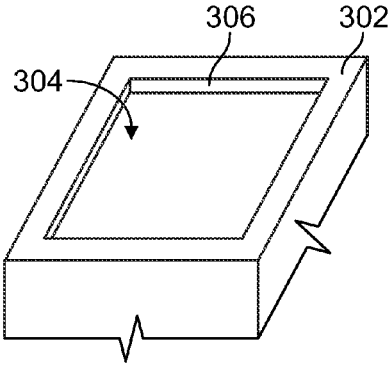

Turning to FIG. 3A, a second side 300 of a block of the modular seating and shelving system is depicted. FIG. 3A depicts a plan view of the second side 300, FIG. 3B depicts the side view of the second side 300, and FIG. 3C, depicts a perspective view of the second side 300 when the second side is viewed from the top of the block. As depicted in FIGS. 3A-3C, the second side 300 includes a second exterior surface 302 and a second lateral surface 306. The second lateral surface 306 extends perpendicular to the second exterior surface 302 towards the interior of the block. The length that the second lateral surface 306 extends in this direction is indicated as 308. The distance between the second lateral surface 306 and the outer edge of the second exterior surface 302 is indicated as a distance 312. The second lateral surface 306 defines a first recess 304 extending towards the interior of the block from the second exterior surface 302. The second lateral surface 306 forms a perimeter around the first recess 304.

Figure 4A:
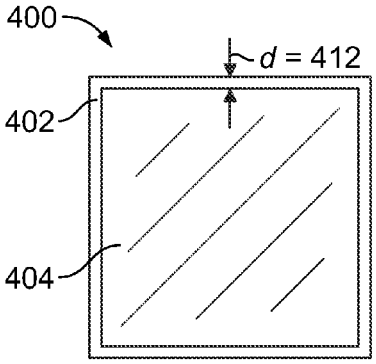
FIGS. 4A-4C are a plan view, a side view, and a perspective view of a third side of a block in accordance with some embodiments.
Figure 4B:
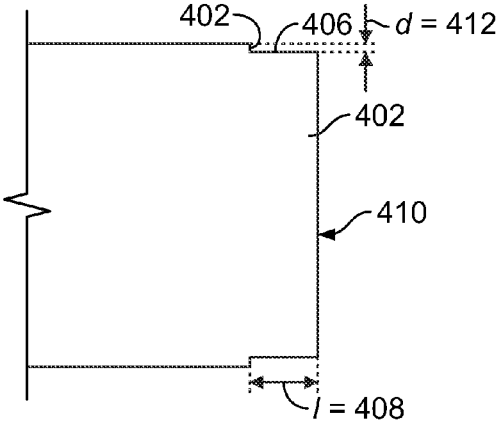
Figure 4C:
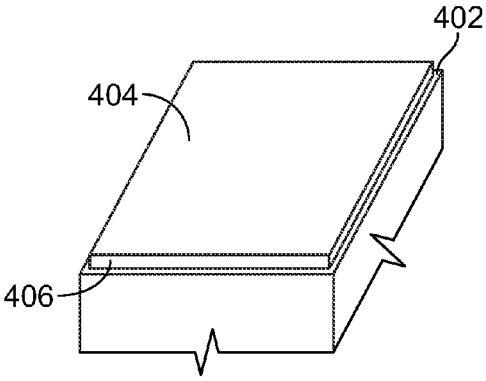

As depicted in FIG. 4A, the block further includes a third, closed side 400. FIG. 4A depicts a plan view of the third side 400, FIG. 4B depicts the side view of the third side 400, and FIG. 4C, depicts a perspective view of the third side 400 when the third side is viewed from the top of the block. The closed side includes a third exterior surface 402 with a second protruding member 404. The second protruding member 404 includes a lateral surface 406 extending perpendicular to the third exterior surface 302 along the perimeter of the second protruding member. The third lateral surface 406 extends outwardly, away from the interior of the block from the third exterior surface 402. The third lateral surface 406 is raised a length 408 away from the interior of the block. The distance between the third lateral surface 406 and the outer edge of the third exterior surface 402 is indicated as the distance 412. The second protruding member 404 also includes an outer surface 410. This outer surface 410 is parallel to the third exterior surface 402. In this embodiment, the outer surface 410 of the second protruding member is a flat smooth outer surface that is suitable for a child to sit on. In one embodiment, the surface area of the second protruding member of the fourth side is greater than the first protruding member of the first side.

Figure 5A:
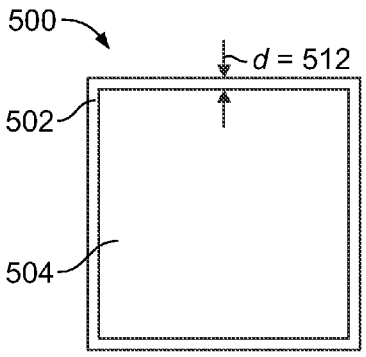
FIGS. 5A-5C are a plan view, a side view, and a perspective view of a fourth side of a block in accordance with some embodiments.
Figure 5B:
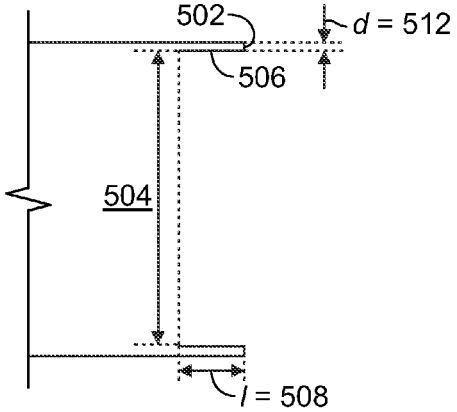
Figure 5C:
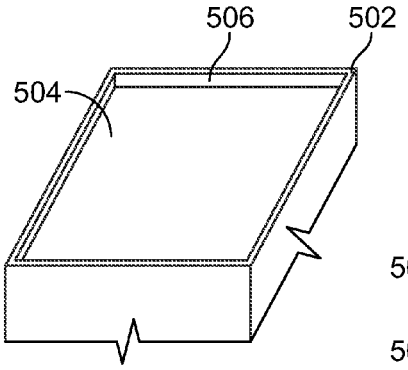

As depicted in FIG. 5A, a fourth side 500 of each block has an opening that enables a user to access the open space inside each block. FIG. 5A depicts a plan view of the fourth side 500, FIG. 2B depicts the side view of the fourth side 500, and FIG. 5C, depicts a perspective view of the fourth side 500 when the fourth side is viewed from the top of the block. The fourth side 500 includes a fourth exterior surface 502 and a fourth lateral surface 506 defining a second recess 504 extending from the fourth exterior surface 502. The fourth lateral surface 506 extends towards the interior of the block from the fourth exterior surface 502. The length that the fourth lateral surface 506 extends towards the interior of the block is indicated by a length 508. The distance between the fourth lateral surface 506 and the outer edge of the fourth exterior surface 502 is indicated as the distance 512.

It should be appreciated that each block includes six sides. In certain embodiments, each block includes two of the first side 200, as described above, two of the second side 300, as described above, one of the third side 400, and one of the fourth side 500. In certain alternative embodiments, each block includes one first side 200, one second side 300, two third sides 400, and two fourth sides 500, or any other combination thereof.

It should be appreciated that the modular seating and shelving system includes at least two blocks. In one embodiment, both blocks have identical sides and both blocks are configured to interlock with one another. In this embodiment, the first side of a first block interlocks with the second side of a second block. More specifically, the first protruding member of the first side of the first block, interlocks with the first recess of the second side of the second block. When the first block interlocks with the second block, the first protruding member 204 of the first block is inserted within the first recess 304 of the second block and the first exterior surface 202 of the first block abuts the second exterior surface 302 of the second block.

For example, in this embodiment, the distance 212 between the first lateral surface 206 and the outer edge of the first exterior surface 202 is just slightly greater than the distance 312 between the second lateral surface 306 and the outer edge of the second exterior surface 302 so that the first protruding member of a first block fits inside the first recess of a second block. In one embodiment, the length 208 of the first lateral side 206, which is the length that the first protruding member 204 extends outwardly from the interior of the block from the second exterior surface 202, is also equivalent to the length 308 of the second lateral side 306, which is the length that the lateral side 306 extends towards the interior of the block. Thus, once the two blocks are interlocked, the outer surface 210 of the first protruding member is parallel with an interior surface of the second side.

In one embodiment, just as the first protruding member of the first side interlocks with the first recess of the second side, the second protruding member of the third side interlocks with the second recess of the fourth side. It should be appreciated that in one embodiment, the distance 512 of the fourth exterior side is just slightly greater than the width 412 of the third exterior side. This is so that in an embodiment with two identical blocks, the second protruding member of the third side of a first block fits within the second recess of the fourth side of a second block.

Figure 6:
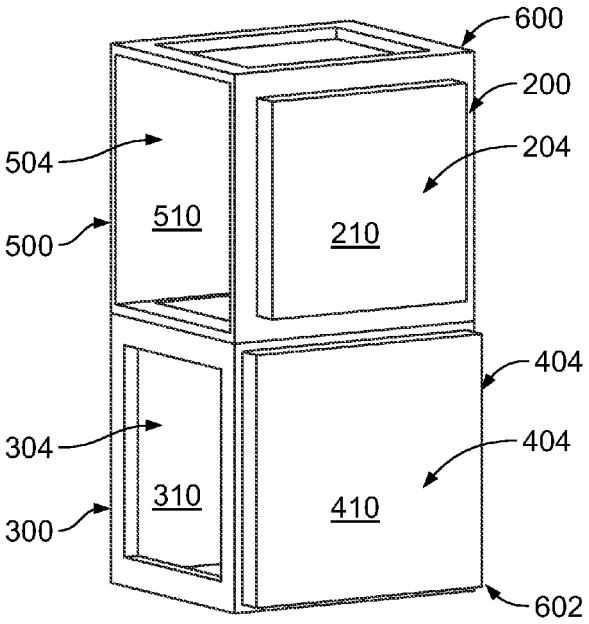
FIG. 6 depicts two blocks in accordance with some embodiments.

Turning to FIG. 6, which depicts two blocks according to one embodiment of the present disclosure. As depicted in FIG. 6, a first block 600 is stacked on top of a second block 602. In this view, the first side 200 of the first block 600 is directly above the third side 400 of the second block 602. As depicted in FIG. 6, the outer surface 410 of the second protruding member 404 of the second block 602, has a greater surface area than the outer surface 210 of the first protruding member 204 of the first side of the first block 600. This is because, as described above, the third side is the closed side. The second protruding member of the closed side may also be utilized as a seat for a child, and therefore has a greater surface area more suitable for a seat.

Additionally, as depicted in FIG. 6, the second recess 504 of the fourth side 500, of the first block 600 has a greater surface area than the first recess 304 of the second side 300 of the second block 602. This is because the second protruding member, with the greater surface area, interlocks with the second recess and the first protruding member interlocks with the first recess. As such, each block includes two different sets of sides that interlock with one another.

Figure 7:
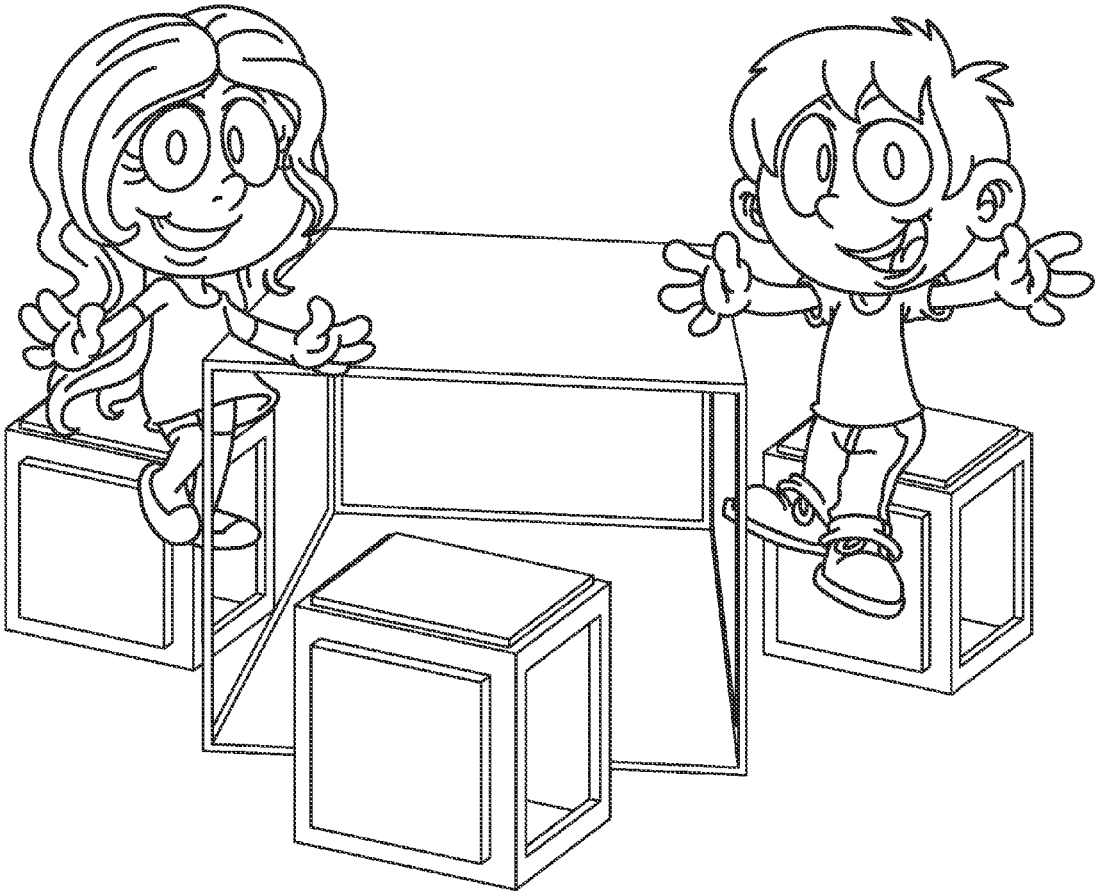
FIG. 7 depicts multiple blocks utilized as furniture in accordance with some embodiments.

In one embodiment, as depicted in FIG. 7, each block is configured to be utilized as a seating unit for children. In this embodiment, the height of each of the blocks in the modular seating and shelving system is the same and is suitable for a child to sit on. It should be appreciated that in certain alternative embodiments, the height for various blocks may be different. The closed side of the block 400 is the seating surface for the child. In one embodiment, the closed side 400 and the open side 500 are on opposite sides of the block. It should be appreciated that this allows for the greatest stability when a child is seated on the closed side.

Figure 8:
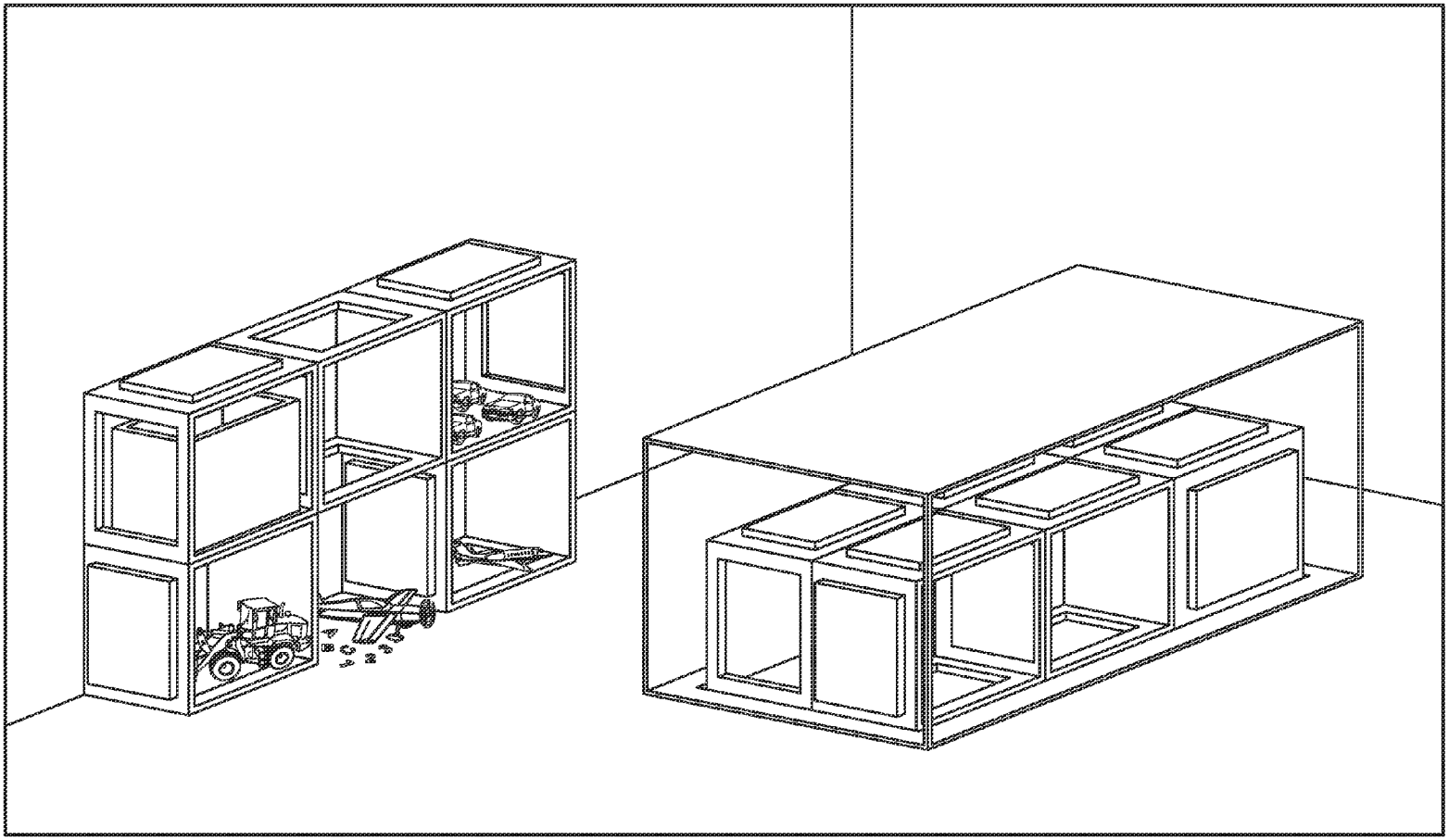
FIG. 8 depicts multiple blocks utilized as furniture in accordance with some embodiments.

As depicted in FIG. 8, each block may be utilized individually as a seat, or several blocks may be interlocked with one another to form other pieces of furniture. In the embodiments described above, each block includes two different sized protruding members and two different sized recesses that fit each protruding member. The fifth and sixth side of each block include any combination of the four sides described above. In certain embodiments, each block in a modular seating and shelving system are identical. In other embodiments, each block in the modular seating and shelving system are identical with respect to the four sides described above, and include a different combination of extra sides five and six. In other embodiments, each block in the modular seating and shelving system includes a different combination of sides.

The configuration of the components of the modular seating and shelving system offers many benefits. In particular, the size and material of the blocks make them suitable for children to maneuver with ease. The protruding members on various sides of the blocks, and the recesses that receive each protruding member, enable a user to stack and interlock the blocks with ease.

This disclosure is intended to explain how to fashion and use various embodiments in accordance with the technology rather than to limit the true, intended, and fair scope and spirit thereof. The foregoing description is not intended to be exhaustive or to be limited to the precise forms disclosed. Modifications or variations are possible in light of the above teachings. The embodiment(s) were chosen and described to provide the best illustration of the principle of the described technology and its practical application, and to enable one of ordinary skill in the art to utilize the technology in various embodiments and with various modifications as are suited to the particular use contemplated. All such modifications and variations are within the scope of the embodiments as determined by the appended claims, as may be amended during the pendency of this application for patent, and all equivalents thereof, when interpreted in accordance with the breadth to which they are fairly, legally and equitably entitled.

The invention claimed is:

1. A modular seating and shelving system comprising:

a first block having a first set of six sides defining a first open interior, and a second block having a second set of six sides defining a second open interior, each block comprising:

at least one first side having a first exterior surface with a first protruding member extending from the first exterior surface, wherein the first protruding member includes a first outer surface and a first lateral surface, the first lateral surface extending along a first perimeter of the first protruding member;

at least one second side including a second exterior surface and a second lateral surface defining a first recess extending from the second exterior surface;

at least one third side including an third exterior surface with a second protruding member extending from the third exterior surface, wherein the second protruding member includes a second outer surface and a third lateral surface, the third lateral surface extending along a second perimeter of the second protruding member, wherein the second outer surface of the second protruding member is a flat surface with a substantially greater surface area than the first outer surface of the first protruding member; and at least one fourth side having an opening, the fourth side including a fourth exterior surface and a fourth lateral surface defining a second recess extending from the fourth exterior surface, wherein the second recess of the fourth side has a substantially greater area than the first recess of the second side;

wherein the first block is configured to interlock with the second block by the first exterior surface of the first block abutting the second exterior surface of the second block, and by the first protruding member of the first block being inserted within the first recess of the second block.

2. The modular system of claim 1, wherein a fifth side of each block is identical to at least one of: (a) the first side, (b) the second side, (c) the third side, and (d) the fourth side.

3. The modular system of claim 1, wherein a sixth side of each block is identical to at least one of: (a) the first side, (b) the second side, (c) the third side, and (d) the fourth side.

4. The modular system of claim 1, wherein the first set of six sides of the first block includes a same quantity of first sides, second sides, third sides, and fourth sides as the second set of six sides of the second block.

5. The modular system of claim 1, wherein the first set of six sides of the first block includes at least one different quantity of first sides, second sides, third sides, and fourth sides from the second set of six sides of the second block.

6. The modular system of claim 1, wherein a distance from an outer edge of the first exterior surface to the first lateral surface of a first block is greater than a distance from an outer edge of the second exterior surface to the second lateral surface of the second block.

7. The modular system of claim 1, wherein a distance from an outer edge of the third exterior surface to the third lateral surface of a first block is greater than a distance from an outer edge of the fourth exterior surface to the fourth lateral surface of the second block.

8. The modular system of claim 1, wherein a length of the first lateral surface of the first block is equal to a length of the second lateral surface of the second block.

9. The modular system of claim 8, wherein when the first protruding member of the first block is inserted within the first recess of the second block, the outer surface of the first protruding member and an interior surface of the second side of the second block are parallel.

10. A modular seating and shelving system comprising:

a first block having a first set of six sides defining a first open interior, and a second block having a second set of six sides defining a second open interior, each block including:

at least one first side having a first exterior surface with a first protruding member extending from the first exterior surface, wherein the first protruding member includes a first outer surface and a first lateral surface, the first lateral surface extending along a first perimeter of the protruding member;

at least one second side including a second exterior surface and a second lateral surface defining a first recess extending from the second exterior surface;

at least one third side including an third exterior surface with a second protruding member extending from the third exterior surface, wherein the second protruding member includes a second outer surface and a third lateral surface, the third lateral surface extending along a second perimeter of the second protruding member, wherein the second outer surface of the second protruding member has a substantially greater surface area than the first outer surface of the first protruding member; and at least one fourth side including a fourth exterior surface and a fourth lateral surface defining a second recess extending from the fourth exterior surface, wherein the second recess of the fourth side has a substantially greater area than the first recess of the second side;

wherein the first block is configured to interlock with the second block by the third exterior surface of the first block abutting the fourth exterior surface of the second block, and by the second protruding member of the first block being inserted within the second recess of the second block.

11. The modular system of claim 10, wherein the second outer surface of the second protruding member has a substantially greater surface area than the first outer surface of the first protruding member.

12. The modular system of claim 11, wherein the second protruding member has a flat outer surface.

13. The modular system of claim 10, wherein a fifth side of each block is identical to at least one of: (a) the first side, (b) the second side, (c) the third side, and (d) the fourth side.

14. The modular system of claim 10, wherein a sixth side of each block is identical to at least one of: (a) the first side, (b) the second side, (c) the third side, and (d) the fourth side.

15. The modular system of claim 10, wherein the first set of six sides of the first block includes a same quantity of first sides, second sides, third sides, and fourth sides as the second set of six sides of the second block.

16. The modular system of claim 10, wherein the first set of six sides of the first block includes at least one different quantity of first sides, second sides, third sides, and fourth sides from the second set of six sides of the second block.

17. The modular system of claim 10, wherein a distance from an outer edge of the first exterior surface to the first lateral surface of a first block is greater than a distance from an outer edge of the second exterior surface to the second lateral surface of the second block.

18. The modular system of claim 10, wherein a distance from an outer edge of the third exterior surface to the third lateral surface of a first block is greater than a distance from an outer edge of the fourth exterior surface to the fourth lateral surface of the second block.

19. The modular system of claim 10, wherein a length of the first lateral surface of the first block is equal to a length of the second lateral surface of the second block.

20. The modular system of claim 19, wherein when the first protruding member of the first block is inserted within the first recess of the second block, the outer surface of the first protruding member and an interior surface of the second side of the second block are parallel.

* * * * *